US009340907B2

(12) United States Patent
Patterson

(10) Patent No.: US 9,340,907 B2
(45) Date of Patent: May 17, 2016

(54) YARNS CONTAINING SILICONIZED MICRODENIER POLYESTER FIBERS

(75) Inventor: Ian Patterson, Ballston Lake, NY (US)

(73) Assignee: PRIMALOFT, INC., Latham, NY (US)

( * ) Notice: Subject to any disclaimer, the term of this patent is extended or adjusted under 35 U.S.C. 154(b) by 71 days.

(21) Appl. No.: 11/476,216

(22) Filed: Jun. 28, 2006

(65) Prior Publication Data

US 2007/0032155 A1 Feb. 8, 2007

Related U.S. Application Data

(60) Provisional application No. 60/695,224, filed on Jun. 29, 2005.

(51) Int. Cl.
*D03D 15/00* (2006.01)
*D04B 1/16* (2006.01)
(Continued)

(52) U.S. Cl.
CPC . *D04B 1/16* (2013.01); *A41B 17/00* (2013.01); *A41D 31/00* (2013.01); *D02G 3/04* (2013.01);
(Continued)

(58) Field of Classification Search
CPC ..... D02G 3/04; D02G 1/0286; D02G 3/22; D02G 3/02; D02G 3/404; D10B 2201/02; D10B 2331/04; D10B 2211/02; D10B 2321/021; D10B 2201/28; D10B 2321/02; D10B 2321/10; D10B 2331/02; D10B 2401/14; D10B 2501/00; D10B 2501/042; D10B 2501/043; Y10S 8/04; D04B 1/16; D04B 1/14; A41B 17/00; A41D 31/00; D03D 15/00; D03D 15/0061; D03D 15/10; Y10T 428/2915; Y10T 428/2938; Y10T 442/3065; Y10T 442/425; Y10T 442/313
USPC ..... 2/69, 115, 159, 227, 239, 243.1, 67; 5/413 R; 19/145.5; 57/254, 256, 313, 57/252, 253, 255, 257, 315, 904; 112/420; 252/608; 313/631, 567, 633; 427/393.3, 407.1, 177, 243, 289, 358, 427/387, 389.9, 393.4, 412, 412.1; 428/361, 369, 375, 163, 172, 359, 362, 428/365, 378, 391, 394, 395, 401, 903, 920, 428/921; 442/197, 333, 136, 147, 189, 308, 442/338, 352, 360, 409, 411, 414
See application file for complete search history.

(56) References Cited

U.S. PATENT DOCUMENTS 2,172,439 A * 9/1939 Dreyfus et al. ..... 57/254
2,260,229 A * 10/1941 Nutter et. al. ..... 57/313
(Continued)

FOREIGN PATENT DOCUMENTS

JP 59-26537 2/1984
JP 59-026537 2/1984
(Continued)

OTHER PUBLICATIONS

Kandolph, Sara and Anna Langford. Textiles. 8th edition. Upper Saddle River, NJ: Merrill, 1998. pp. 166-171 & 176-198.*
(Continued)

*Primary Examiner* — Jeremy R Pierce
(74) *Attorney, Agent, or Firm* — Heslin Rothenberg Farley & Mesiti P.C.

(57) ABSTRACT

The invention relates to a yarn containing siliconized micro-denier polyester fibers and macro-denier fibers. The blending ratio of the siliconized micro-denier polyester fibers and macro-denier fibers in the yarn ranges between about 10 to about 90 and about 90 to about 10 percent by weight. The macro-denier fiber of the yarn is selected from the group consisting of a synthetic fiber, a natural fiber, and a combination of synthetic and natural fibers. The invention also relates to a woven or knitted fabric and articles of clothing containing the yarn of the invention, either alone or in combination with other yarns.

26 Claims, 1 Drawing Sheet

(51) Int. Cl.

| | |
|---|---|
| ***A41B 17/00*** | (2006.01) |
| ***A41D 31/00*** | (2006.01) |
| ***D02G 3/04*** | (2006.01) |
| ***D02G 3/40*** | (2006.01) |
| ***D03D 15/10*** | (2006.01) |
| ***D04B 1/14*** | (2006.01) |

(52) U.S. Cl.

CPC ..... *D02G 3/404* (2013.01); *D03D 15/00* (2013.01); *D03D 15/0061* (2013.01); *D03D 15/10* (2013.01); *D04B 1/14* (2013.01); *D10B 2201/02* (2013.01); *D10B 2201/04* (2013.01); *D10B 2201/28* (2013.01); *D10B 2211/02* (2013.01); *D10B 2211/04* (2013.01); *D10B 2321/02* (2013.01); *D10B 2321/10* (2013.01); *D10B 2331/02* (2013.01); *D10B 2331/04* (2013.01); *D10B 2401/14* (2013.01); *D10B 2501/00* (2013.01); *D10B 2501/042* (2013.01); *D10B 2501/043* (2013.01); *Y10T 428/2915* (2015.01); *Y10T 428/2938* (2015.01); *Y10T 442/3065* (2015.04); *Y10T 442/313* (2015.04); *Y10T 442/425* (2015.04)

(56) References Cited

U.S. PATENT DOCUMENTS

| | | | | | |
|---|---|---|---|---|---|
| 3,271,189 | A | * | 9/1966 | Hofmann | 428/369 |
| 3,702,260 | A | * | 11/1972 | Templeton et al. | 428/361 |
| 4,040,371 | A | * | 8/1977 | Cooper et al. | 112/420 |
| 4,054,695 | A | * | 10/1977 | Johnson | 427/393.3 |
| 4,199,642 | A | * | 4/1980 | Cooper et al. | 442/333 |
| 4,281,042 | A | * | 7/1981 | Pamm | 428/361 |
| 4,304,817 | A | | 12/1981 | Frankosky | |
| 4,991,387 | A | | 2/1991 | Tashiro et al. | |
| 5,590,420 | A | | 1/1997 | Gunn | |
| 5,591,523 | A | | 1/1997 | Aneja | |
| 5,592,523 | A | | 1/1997 | Tuy et al. | |
| 5,752,278 | A | | 5/1998 | Gunn | |
| 5,829,057 | A | | 11/1998 | Gunn | |
| 5,837,370 | A | | 11/1998 | Aneja | |
| 5,997,980 | A | | 12/1999 | Matoba et al. | |
| 6,060,829 | A | | 5/2000 | Kubon et al. | |
| 6,143,368 | A | | 11/2000 | Gunn | |
| 2003/0039834 | A1 | | 2/2003 | Gunn | |
| 2003/0167581 | A1 | | 9/2003 | Yamazaki et al. | |

FOREIGN PATENT DOCUMENTS

| | | | |
|---|---|---|---|
| RO | 83257 | | 9/1984 |
| WO | 01/88237 | A1 | 11/2001 |

OTHER PUBLICATIONS

Kandolph, Sara and Anna Langford, Textiles 8th Edition. Upper Saddle River, NJ: Merrill, 1998. pp. 166-171 & 176-198.

International Search Report mailed Jan. 24, 2008 for International Application No. PCT/US06/25156.

Official Action, Japanese Patent Application No. 2012-139871, Japan Patent Office, Oct. 22, 2013.

* cited by examiner

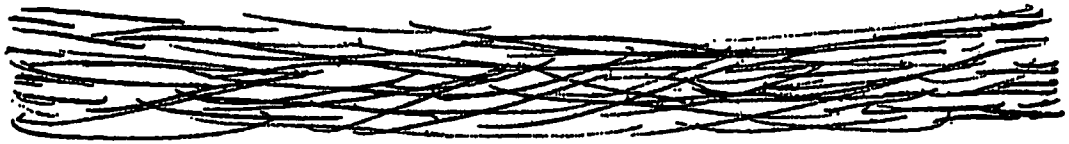

YARNS CONTAINING SILICONIZED MICRODENIER POLYESTER FIBERS

CROSS REFERENCE TO RELATED APPLICATIONS

This application claims priority under 35 U.S.C. §119 to U.S. provisional application No. 60/695,224, filed Jun. 29, 2005, which is incorporated herein by reference.

FIELD OF INVENTION

The invention is directed to a yarn having siliconized micro-denier polyester fibers and macro-denier fibers. The invention also provides fabric as well as articles of clothing, e.g. socks or sweaters, containing such a yarn.

BACKGROUND OF THE INVENTION

Yarns produced from natural fibers such as cotton, wool and linen as raw materials having excellent feel, however, can have drawbacks such as durability, relatively low strength, large shrinkage after washing and, consequently, large configurational change. In order to cope with such drawbacks, yarns have been used by blending natural fibers and synthetic staple fiber. This fiber blend gives improvements in strength and in shape stability. For several decades, ever since the development of synthetic fibers and materials, yarns containing synthetic fiber, especially polyester fiber, have been made into textile fabrics, woven or knitted. There has been continuing interest to create the better hand and comfort of the fibers in fabrics and clothing articles. Accordingly, much effort has been devoted toward developing improved yarns using synthetic fibers which can be woven or knitted into articles of clothing such as socks and sweaters.

Various approaches to address these needs have been described. U.S. Pat. No. 4,040,371 discloses polysiloxane coated polyester fibers blended with other fibers for improving the flame-resistance of polyester fiberfill. Another polyester fiberfill blend consisting of three components: (i) slicked crimped polyester staple fiber of denier about 0.5 to about 3; (ii) unslicked crimped polyester stable fiber of denier about 0.5 to about 3; and (iii) crimped staple binder fiber of polymer was disclosed in U.S. Pat. No. 4,304,817. Examples of slickeners were polysiloxane coating compositions. U.S. Pat. No. 4,991,387 discloses a polyester and cotton blended yarn capable of obtaining a polyester and cotton blended fabric having a superior bulkiness and a soft touch, wherein the polyester cotton blended yarn comprising of a coarse denier staple fiber and a fine denier staple fiber.

U.S. Pat. Nos. 5,590,420, 5,752,278, 5,829,057, 6,060,829, and 6,1433,368 disclose low coefficient of friction apparel, outer apparel and fibers which incorporates fabrics or chemicals having low coefficient of friction either overall or in specific areas of the apparel that will minimize the development of blisters, calluses, and irritation of the skin. U.S. published application No. 2003/0039834 discloses fibers having a low coefficient of friction comprising a polymeric component and a low friction component, wherein the polymeric component is combined with the low friction component. Examples of the polymeric component include polyester, nylon, acrylics, aramids, polyethylene and the low friction component includes boron, molybdenum, ultra molecular weight silicone, siloxane, and silicone/silane modified polymers.

These efforts have been successful in some areas; however, there still exists a need and desire for a yarn with better hand and comfort which can be woven or knitted into fabrics and articles of clothing. The invention answers that need by providing a yarn comprising siliconized micro-denier polyester fibers and macro-denier fibers. Yarns of the invention have a soft feel and touch that the consumers of the fabrics and clothing articles desire.

SUMMARY OF THE INVENTION

The invention relates to a yarn containing siliconized micro-denier polyester fibers and macro-denier fibers. The blending ratio of the siliconized micro-denier polyester fibers and macro-denier fibers in the yarn ranges between about 10 to about 90 and about 90 to about 10 percent by weight. The macro-denier fiber of the yarn is selected from the group consisting of a synthetic fiber, a natural fiber, and a combination of synthetic and natural fibers. The invention also relates to a woven or knitted fabric containing the yarn of the invention, either alone or in combination with other yarns.

BRIEF DESCRIPTION OF DRAWINGS

FIG. 1 depicts a yarn of the invention.

DETAILED DESCRIPTION OF THE INVENTION

The invention is directed to a yarn for use in weaving or knitting a fabric or article of clothing, such as socks and sweaters. A yarn according to the invention contains siliconized micro-denier polyester fibers and macro-denier fibers. The blending ratio of the siliconized micro-denier polyester fibers and macro-denier fibers in the yarn ranges between about 10 to about 90 and about 90 to about 10, preferably between about 30 to about 70 and about 70 to about 30, and may be 50:50 percent by weight. The amount for the siliconized micro-denier polyester fibers and the macro-denier fibers may vary depending upon the feel and touch desired for the fabrics.

A yarn of the invention may comprise siliconized micro-denier polyester fibers and macro-denier synthetic fibers. Another embodiment of the yarn of the invention may comprise siliconized micro-denier polyester fibers and macro-denier natural fibers. The yarn of the invention may also comprise siliconized micro-denier polyester fibers, macro-denier synthetic fibers, and macro-denier natural fibers. The yarn of the invention may be colored or have a natural color, depending upon the fiber blends. For colored yarns, the micro-denier polyester fiber is preferably dyed prior to coating with silicone.

The invention is not limited to any particular type of yarn. The term "yarn" is a generic term, referring to a continuous strand of textile fibers, filaments, or materials, wherein the individual staple fibers are of a length shorter that the yarn length, in a form suitable for knitting, weaving, or otherwise intertwining to form a fabric. Commons types of yarn known in the art include, for example, the following form s: (1) a number of fibers (e.g., staple) twisted together (spun yarn); (2) a number of filaments laid together without twist (a zero-twist yarn); and (3) a number of filaments laid together with a degree of twist. Yarns of the invention may be produced by techniques known in the art. A yarn of the invention may be produced by spinning material such as natural or synthetic fibers, or combination thereof, to which is added siliconized micro-denier fibers. The yarn may be produced by open end spinning or dreft spinning. The yarn could be produced on a woolen system or a worsted system depending on the count of yarn required for the end product. FIG. 1 is a side perspective view of a yarn incorporating the principles of the invention. The yarn of the invention may also be twisted and plied together with another yarn of the same material and type, or may be twisted and plied together with a yarn of a different material and type.

Denier is a measure of the fineness of a fiber. If 9000 meters of a fiber weighs 1 gram, that fiber is 1 denier. The lower the denier, the finer is the fiber size and the higher the denier, the coarser is the fiber. Yarns can also be described by a denier as well, but in the context here, denier is used to describe the fibrous components of the yarn. A "micro-denier polyester fiber" according to this invention is a fiber having a denier of 1.0 or less. Preferably, the micro-denier polyester fiber is about from about 0.5 to 1.0 denier, and more preferably from 0.7 to 0.9 denier. If the micro-denier polyester fiber is colored a coarser micro-denier fiber, e.g. 0.9 denier, is preferred. A macro-denier fiber according to the invention has a denier of greater than 1.0. The preferable range of the macro-denier fiber is about from 1.2 to about 6, more preferably from about 1.2 to 4.5 denier. Generally speaking, wool, a preferred micro-denier fiber for use in a yarn of the invention, has a normal denier of approximately 4 to 4.5 denier. Preferably, a synthetic macro-denier fiber such as polyethylene terephthalate, ranges from about 1.2 to about 1.5 denier.

The fiber length of the micro-denier polyester fiber and the synthetic macro-denier fiber may vary from about 1.5 to about 4 inches. Preferably, the fiber length in both types is from about 2 to about 3 inches. As one of ordinary skill knows, natural fibers, such as wool or cotton, naturally vary in length. The denier and fiber length of the synthetic fibers may be varied depending upon the commercial needs of fabrics and clothing articles.

The silconized micro-denier polyester fiber may be made of any polyester known in the art to prepare textile fibers. Exemplary polyesters used in textiles are terephthalate polyesters such as poly(ethylene terephthalate), poly(hexahydro-p-xylylene terephthalate), poly(butylene terephthal ate), poly-1,4-cyclohexylene dimethylene (PCDT) and terephthal ate copolyesters in which at least 85 mole percent of the ester units are ethylene terephthalate or hexahydro-p-xylylene terephthalate units. Preferably, the micro-denier polyester fiber is a polyethylene terephthalate (PET).

The macro-denier fibers of the yarn are not particularly limited, and can be selected in conformity with the properties desired for a particular fabric or article of clothing as is known in the textile art. The macro-denier fiber may be a synthetic fiber, a natural fiber, or a combination of natural fibers, synthetic fibers, or natural and synthetic fibers. Natural macro-denier fibers may be any of natural fibers such as wool, cotton, linen, silk, and cellulosic fibers. Synthetic macro-denier fibers include, for example, polyester fibers such as those discussed above, acrylic fibers, polyamide fibers such as nylon, polyolefin fibers, acetate fibers, etc. The preferred natural macro-denier fiber is wool. The preferred synthetic macro-denier fiber is a polyester fiber.

As mentioned above, the micro-denier polyester fiber of a yarn is a siliconized micro-denier polyester fiber. The term "siliconized" means that the surface of the micro-denier polyester fiber is coated with a silicone polymer The silicone, also called organosiloxanes or polysiloxanes, bonds well to the micro-denier polyester fibers, and reduces friction to improve the hand of the yarn and fabric The silicone coating adheres to the fiber and does not come off after repeated washings. A silicone coating may be applied to the micro-denier polyester fibers prior to blending with the microfibers using methods known in the art to apply silicone coatings, e.g. spraying, mixing, dipping, or padding. The silicone coating is preferably a polysiloxane such as a methylhydrogenpolysiloxane, modified methylhydrogenpolysiloxane, polydimethylsiloxane, or amino modified dimethylpolysiloxane. Siliconized micro-denier polyester fiber, e.g. siliconized micro-denier PET fiber, is commercially available from Wellman, Inc., Fort Mill, S.C. In one embodiment of the yarns of the invention when a synthetic macro-denier fiber is used, that macro-denier fiber may also be siliconized as just described with regard to the micro-denier polyester fiber.

As is known in the art, the polysiloxane may be applied directly or diluted with a solvent as a solution or emulsion, e.g. an aqueous emulsion of a polysiloxane. The coating may then be dried and/or cured. As is known in the art, a catalyst may be used to accelerate the curing of the polysolixane containing Si—H bonds and, for convenience, may be added to a polysiloxane emulsion and the combination used to treat the fiber. Suitable catalysts are iron, cobalt, manganese, lead, zinc, and tin salts of carboxylic acids such as acetates, octanoates, naphthenates and oleates. The fibers may be dried to remove residual solvent and then heated to between 65° and 200° C. to cure.

The yarn of the invention may be used in fabrics and articles of clothing. Incorporating siliconized micro-denier polyester fibers into a yarn according to the invention reduces the yarn's coefficient of friction which results in a softer feel for the yarn or a fabric or article of clothing containing the yarn. Fabrics are planar structures made of fibers and/or yarns assembled by various means known in the art, including, but not limited to, weaving, knitting, tufting, or braiding to give the structure sufficient strength and other properties required for its intended use. The articles of clothing formed from these yarns and fabrics include, but are not limited to, shirts, pants, coveralls, overalls, jackets, sweaters, liners, coats, parkas, headwear, and footwear such as socks. The fabrics and articles of clothing are preferably woven or knitted. Woven fabrics include plain, twill, and satin weaves. Knitted fabrics include warp and weft knitted fabrics.

Accordingly, the invention provides a fabric or article of clothing containing yarns of the invention. The fabric or article of clothing may be produced from only the yarn of the invention but is preferably a combination of a yarn of the invention with other yarns. A preferred embodiment is a woven or knitted fabric or a woven or knitted article of clothing containing a blend of yarns one of which is a yarn of the invention. The weave may be a balanced weave or knit or an unbalanced weave or knit. Balanced weave or knit means that both sides of the fabric contain essentially equal amounts of the inventive yarn. An unbalanced weave or knit means that one side of the fabric, by design and a desired outcome, has more of the inventive yarn than the other side. The fabric or article of clothing may contain the yarn of the invention throughout or only in desired areas to improve feel or reduce friction. For example, a yarn of the invention may be included in the heel portion of a sock to improve comfort and wearability.

Fabrics and articles of clothing made with a yarn of the invention may have better insulation properties, water repellence, softness and wind resistance. These properties are, of course, relative to a similar fabric without the yarn.

EXAMPLES

Examples of the fiber blends of the yarn of the invention are listed below. The percentages relate to weight.

Example 1

45% of 0.7 denier×3 inches long siliconized PET fiber, and
55% 19 micron wool (equivalent to an approximately 4.5 denier fiber).

Example 2

40% 0.9 denier×2 inches long siliconized PET fiber,
15% 1.4 denier×2 inches PET fiber, and
45% 22 micron wool

Example 3

40% 0.7 denier×3 inches long siliconized PET fiber,
15% 1.4 denier×2 inches PET fiber, and
45% 22 micron wool Example 4

50% of 0.7 denier×3 inches long siliconized PET fiber, and
50% wool

Example 5

20% 0.9 denier×3 inches long siliconized PET fiber,
30% 1.4 denier×1.5 inches long siliconized PET fiber, and
50% wool Example 6

70% 0.7 denier×3 inches long siliconized PET fiber, and
30% wool

Example 7

60% 0.7 denier×3 inches long siliconized PET fiber, and
40% wool

Example 8

20% of 0.9 denier×3 inches long siliconized PET fiber
30% of 1.4 denier×1.5 inches long siliconized PET fiber, and
50% wool Example 9

70% of 0.7 denier×3 inches long siliconized PET fiber, and
30% wool

Example 10

60% of 0.7 denier siliconized×3 inches long PET fiber, and
40% wool.

Modifications to the above would be obvious to those skilled in the art, but would not bring the invention so modified beyond the scope of the appended claims.

The claimed invention is:

1. A yarn, comprising:

a. siliconized micro-denier polyester fibers having a denier of 0.5 to 1.0;

b. non-siliconized macro-denier fibers having a denier of greater than 1.0; and c. siliconized synthetic macro-denier fibers having a denier from 1.2 to 1.5;

wherein a blending ratio of the siliconized micro-denier polyester fibers to the non-siliconized and siliconized macro-denier fibers in the yarn ranges from 10 to 90 to 20 to 80 percent by weight, and wherein said yarn is a spun yarn or a worsted yarn.

2. The yarn of claim 1, wherein the siliconized micro-denier polyester fibers are polyethylene terephthalate fibers.

3. The yarn of claim 1, wherein the non-siliconized macro-denier fibers are natural fibers.

4. The yarn of claim 3, wherein the siliconized synthetic macro-denier fibers are selected from the group consisting of polyamide, polyester, acrylic, acetate, nylon, polyolefin and a combination thereof.

5. The yarn of claim 3, wherein the natural fibers are selected from the group consisting of wool, cotton, silk, and linen.

6. The yam of claim 1, wherein the siliconized micro-denier polyester fibers have a length of 1.5 to 4 inches.

7. The yarn of claim 1, wherein the siliconized micro-denier polyester fibers have a length of 1.5 to 4 inches;

b. the non-siliconized macro-denier fibers are wool fibers; and the siliconized synthetic macro-denier fibers are polyester fibers.

8. A woven or knitted fabric comprising a yarn of claim 1, 3, 6, or 7.

9. The fabric of claim 8, further comprising at least one other yarn.

10. The fabric of claim 9 having a balanced weave or knit.

11. The fabric of claim 9 having an unbalanced weave or knit.

12. A woven or knitted article of clothing comprising a yarn of claim 1, 3, 6, or 7.

13. The article of clothing of claim 12, further comprising at least one other yarn.

14. The article of clothing of claim 13 having a balanced weave or knit.

15. The article of clothing of claim 13 having an unbalanced weave or knit.

16. The article of clothing of claim 12, wherein the article of clothing is a sock or a sweater.

17. A yarn comprising a yarn of claim 1, 3, 6, or 7 twisted or plied with another yarn.

18. The yarn of claim 1, wherein the siliconized micro-denier polyester fibers range in denier from 0.7 denier to 0.9 denier and have a length of 1.5 inches to 4 inches, and wherein the non-siliconized macro-denier fibers range in denier from 1.2 denier to 6 denier.

19. The yarn of claim 1, wherein the siliconized micro-denier polyester fibers range in denier from 0.7 denier to 0.9 denier and have a length of 2 to 3 inches, and wherein the non-siliconized macro-denier fibers range in denier from 1.2 denier to 4.5 denier.

20. The yarn of claim 1, wherein the non-siliconized macro-denier fibers are wool fibers.

21. The yarn of claim 18, wherein the non-siliconized macro-denier fibers are wool fibers.

22. The yarn of claim 19, wherein the non-siliconized macro-denier fibers are wool fibers.

23. The yarn of claim 18, wherein the siliconized micro-denier polyester fibers are polyethylene terephthalate fibers.

24. The yarn of claim 1, wherein the siliconized synthetic macro-denier fibers are polyester fibers.

25. The yarn of claim 1, wherein the siliconized synthetic macro-denier fibers are polyethylene terephthalate fibers.

26. The yarn according to claim 1, wherein the yarn comprises 30-55 wt % of the non-siliconized macro-denier fibers.

* * * * *